United States Patent [19]

Repetti

[11] 4,176,670

[45] Dec. 4, 1979

[54] STORING AND FEEDING DEVICE FOR FLAT PARTS

[75] Inventor: Pierre Repetti, Prilly, Switzerland

[73] Assignee: Systems and Technics S.A., Gland, Switzerland

[21] Appl. No.: 878,943

[22] Filed: Feb. 17, 1978

[30] Foreign Application Priority Data

Feb. 21, 1977 [CH] Switzerland ..... 2122/77

[51] Int. Cl.[2] ..... G07D 1/00

[52] U.S. Cl. ..... 133/4 R; 133/1 R; 141/321

[58] Field of Search ..... 133/1 R, 1 A, 4 R, 5 R, 133/5 A, 5 B, 8 R, 8 A; 221/310, 287, 288, 289, 197, 198; 141/321

[56] References Cited

U.S. PATENT DOCUMENTS

| | | | |
|---|---|---|---|
| 1,637,549 | 8/1927 | Chandler | 133/1 R |
| 3,409,172 | 11/1968 | Fuglsang-Madsen et al. | 221/289 X |

*Primary Examiner*—Francis J. Bartuska

*Attorney, Agent, or Firm*—Young & Thompson

[57] ABSTRACT

A storing and feeding device for coins comprises a tube having an end that widens toward the outside, with retainers at the widened end of the tube for retaining the coins. The tube is slidably mounted on a support that has resilient pads that widen the retainers to free the coins. The coins, in turn, have a packaging comprising an opening strip and a sealing flange. The opening strip is accessible from outside the tube through a longitudinal opening in its wall.

9 Claims, 4 Drawing Figures

FIG. 3
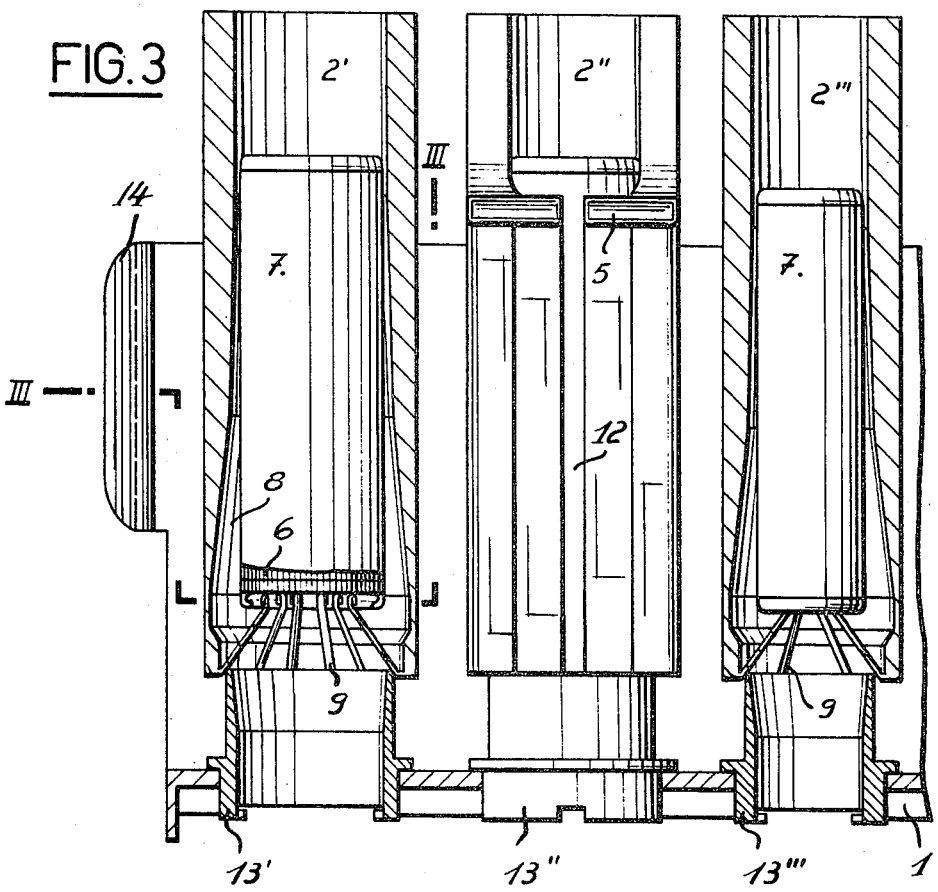
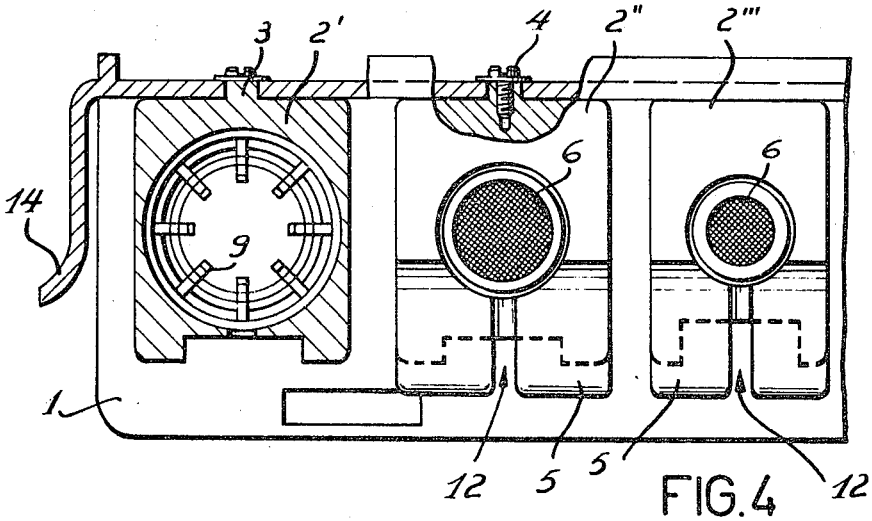
FIG. 4

STORING AND FEEDING DEVICE FOR FLAT PARTS

The present invention relates to a storing and feeding device for flat parts, for example coins or tokens of circular, polygonal or other shape. This device is intended to feed particularly coin or token dispensers, manual or automatic coin distributors, and so on.

The aim of this invention resides therefore in a storing and feeding device for flat parts, which characterises itself by the fact that it comprises a tube having at least one portion of its internal crossection such as the parts slides freely within the tube and one end portion of which presents an internal wall widening towards the outside, by the fact that the tube comprises, near its widened open end, retaining means defining in storage position an area of smaller dimension than the crossection of the parts to be stored and by the fact that the tube is slidably mounted on a support provided with opening means intented to widen the retaining means and to liberate the parts in order to feed a machine with which said support cooperates.

The attached drawing shows schematically and by way of example one embodiment of the device according to the invention.

FIG. 3 is a view in partial vertical crossection of a group of devices according to the invention.

FIG. 4 is a top view partially in crossection along line III—III of FIG. 3.

Figure 1:
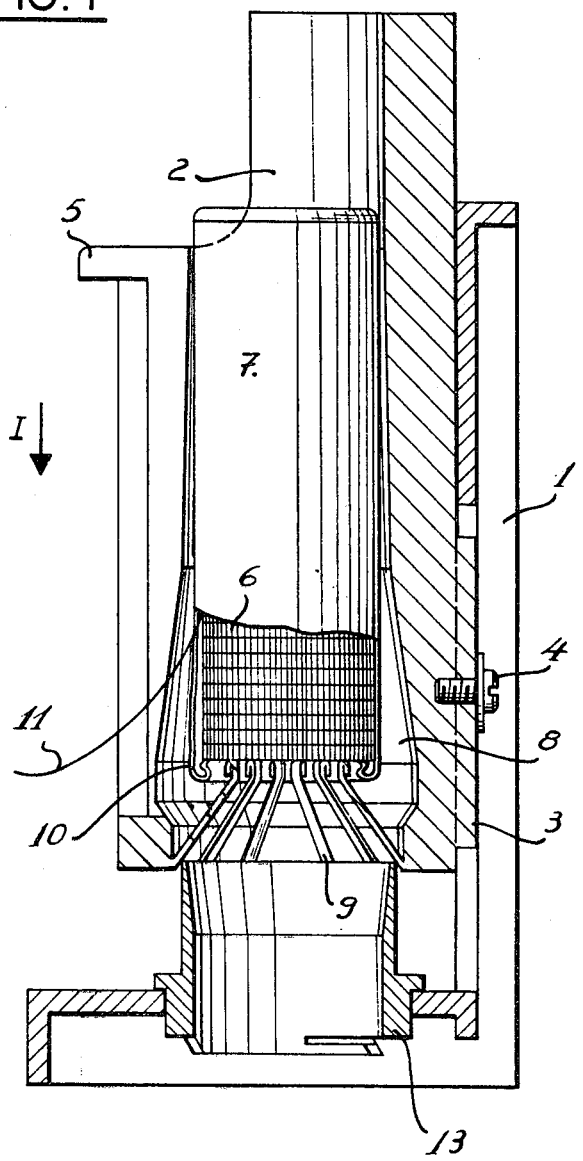
FIGS. 1 and 2 are views in vertical crossections of the device in storing position and in feeding position respectively.

The embodiment of the device according to the invention shown by way of example with reference to the attached drawing is more particularly intended to receive rolls of coins provided with a packaging comprising at least a sealing flange at one of its ends and a tearing down strip for the opening of said packaging.

This embodiment comprises a support 1 intended to be fixed, preferably in a removable way, onto a coin dispenser, a coin changer and so on, and a storing tube 2, slidably mounted along a vertical direction along arrow I onto the support 1.

More precisely, the tube 2 is provided with an axial shoulder, extending vertically 3, which cooperates with a vertical opening provided in the support 1, a screw 4 and washer being for example provided to hinder the shoulder to come out of the said opening.

The upper portion of the outside wall of the tube 2 is further provided with a flange 5 to facilitate the manipulation of the tube.

The storing tube 2 is open at both ends; the internal diameter of the upper portion being slightly greater than the one of the parts to be stored 6, more precisely within their packaging 7, in order to be able to slide freely. The inside diameter of the lower portions increases, then is again reduced at the lower end, so as to form a conical chamber 8.

The lower end of the tube 2 is further provided with resilient pads 9, uniformly distributed over the periphery and extending inwardly of the tube 2 and in direction of its central axis. The resilient pads 9 may be either made out of one piece of manufacture with the rest of the tube 2, made for example out of a plastic material such as "Delrin," or may be welded or screwed onto the lower edges of the tube 2.

In the storing position as shown on FIG. 1, the pile of coins 6 within their packaging 1 rests on the free end of the resilient pads 9 which forms retaining means, the sealing flange 10 of the packaging 7 being excentric with respect to the circle formed by the said ends.

Furthermore, the opening strip 11 of the packaging 7 can be reached from the outside thanks to a continuous vertical opening 12 provided in the wall of the tube 2.

Referring always to the storing position as shown in FIG. 1, the basis of the resilient pads 9 rests onto the upper periphery of a cylindrical opening member 13, fast with the support 1 and coaxial to the tube 2. The lower portion of this member 13 is intended to make the linkage between the device according to the invention and the apparatus on which it is mounted by means of the support 1.

Figure 2:
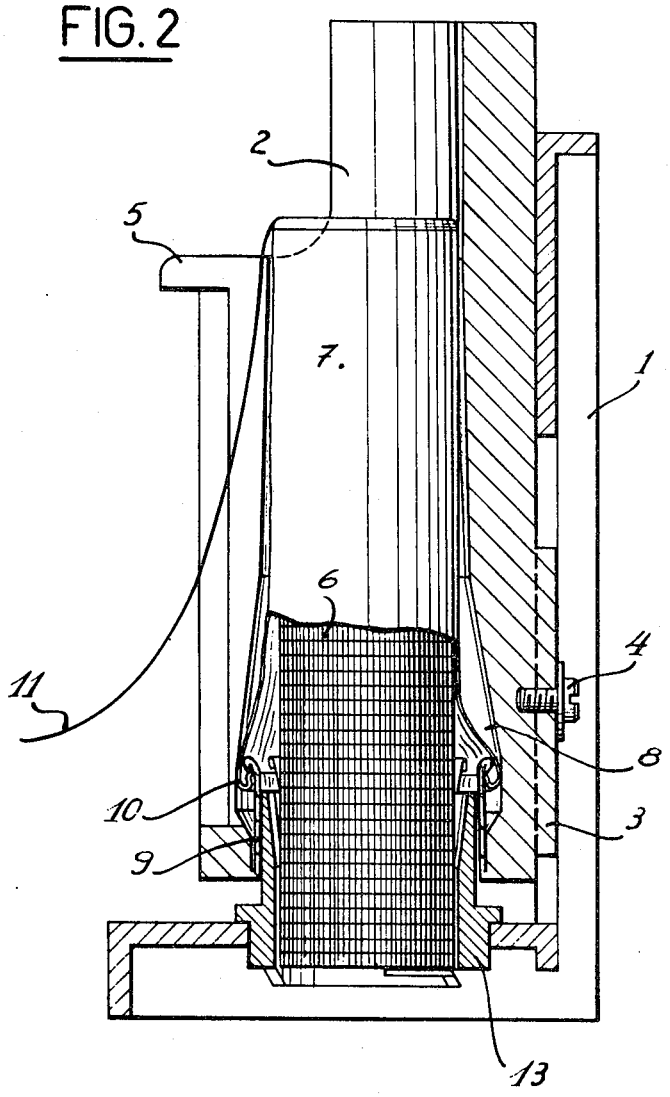
Figure 1:
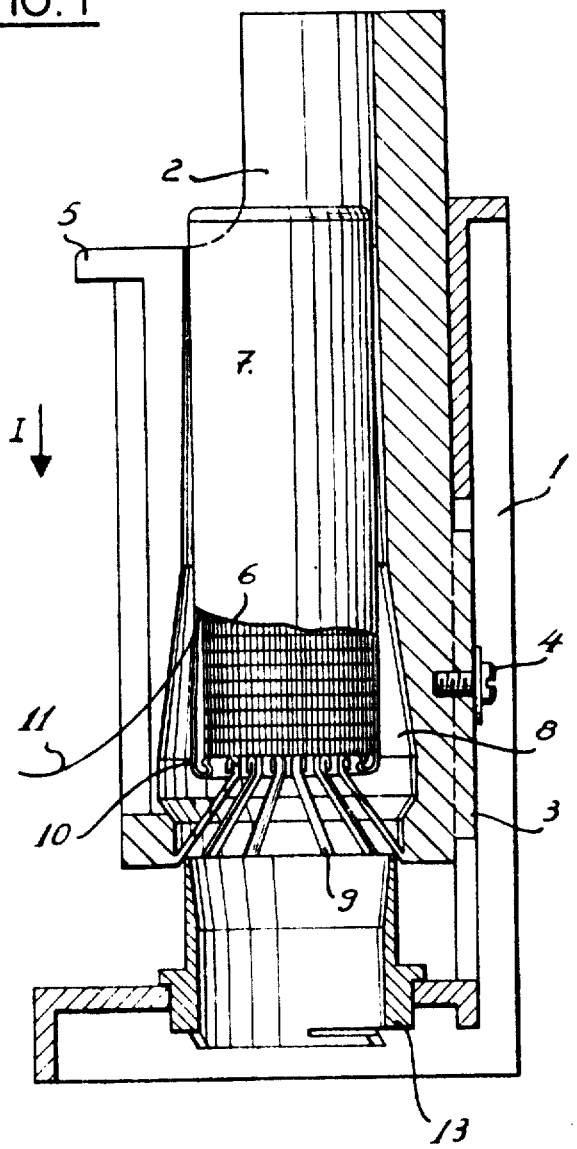
Figure 2:
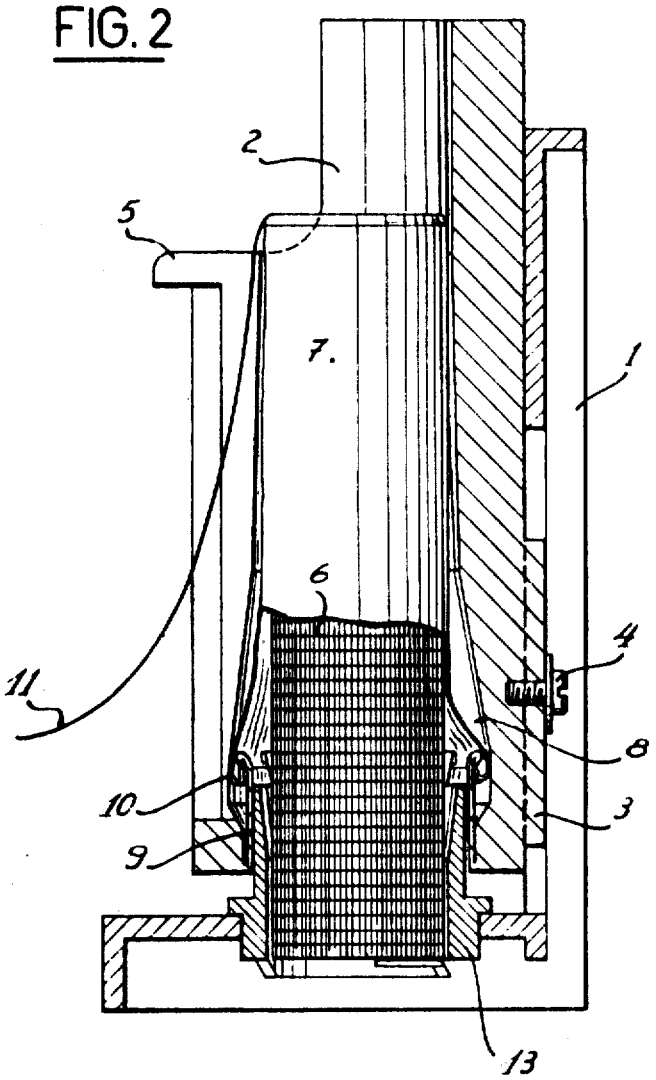

To pass from the storage position (FIG. 1) to the feeding position (FIG. 2) the opening strip 11 has to be pulled completely upwardly in order to open the packaging 7, then on pushes the sliding tube 2 downwardly along the arrow I (FIG. 1). During this downward movement, the resilient pads 9 are spread out by the upper end of the opening member 13, and cause the speading towards the outside of the chamber 8 of the sealing flange 10, up to the position shown in FIG. 2. The coins 6 are liberated and can fall by gravity within the opening member 13 and feed thus the apparatus on which the device according to the invention is fastened.

Once all the coins 6 have been transferred to the coin dispenser or changer, for example, the tube 2 is retracted upwardly so that the resilient pads 9 come back towards the axis of the tube 2 and liberate the sealing flange 10; The packaging 7 can then be taken out of the tube 2 by pulling it upwardly by means of the strip 11, and a new pile of packed pieces can be introduced into the upper opening of the tube 2, the strip of the package passing through the corresponding vertical opening.

FIGS. 3 and 4 show an example of a group of several devices according to the invention (here 3) mounted on only one support 14 intented to be fixed in a removable way to a coin dispenser. Each of the storing tubes 2', 2'' and 2''' has an inside diameter choosen according to the dimension of the coins it receives and the respective opening members 13', 13'' and 13''' have also an appropriated internal diameter.

The storing and feeding device for flat parts according to the invention has among others, the advantage to be of a rapid and easy use, and above all to avoid to the user any contact with the coins themselves during the introduction of the coins within the storing tube with their package provided with an opening strip which can be reached from the outside.

I claim:

1. Storing and feeding device for flat parts characterized by the fact that it comprises a tube having at least one portion of its internal cross section such that the parts slide freely within the tube and one end portion of which presents an internal wall widening towards the outside, by the fact that the tube comprises, near its widened open end, retaining means defining in storage position an area of smaller dimension than the cross section of the parts to be stored, by the fact that the tube is slidably mounted on a support provided with opening means adapted to widen the retaining means and to liberate the parts in order to feed a machine with which said support cooperates, and by the fact that the flat parts are provided with a packaging comprising an opening strip and at least a sealing flange, the opening strip being accessible from the outside of the tube through a longitudinal opening provided in its wall.

2. Device according to claim 1, characterized by the fact that the retaining means are formed by a plurality of resilient pads fast with the widened end of the tube and extending inwardly of the tube towards its axis.

3. Device according to claim 2, characterized by the fact that the resilient pads are mounted onto the periphery of the widened tube opening.

4. Device according to claim 2, characterized by the fact that the resilient pads are made of one piece of manufacture with the tube.

5. Device according to claim 2, characterized by the fact that the tube and the resilient pads are made in a plastic material.

6. Device according to claim 1, characterized by the fact that the opening means is fast with the support and is a cylindrical member coaxial with the tube the end of which extending towards the tube is open and the other end of which cooperates with the machine to be fed, and by the fact that the internal crossection of this member is such that the parts slide freely within it and that the periphery of its open end constitute rest means and simultaneously a spreading means of the retaining means.

7. Device according to claim 1, characterized by the fact that in feeding position, the position of the sliding tube is such that the retaining means are maintained in spreaded position by the opening member in the widened portion of the tube.

8. Device according to claim 1, characterized by the fact that the flat parts are coins.

9. Device according to claims 1, characterized by the fact that the sealing flange is, in storing position, outside of the area defined by the retaining means, and, in feeding position, spread out in the widened portion of the tube by means of said retaining means.

* * * * *

UNITED STATES PATENT AND TRADEMARK OFFICE

CERTIFICATE OF CORRECTION

PATENT NO. : 4,176,670

DATED : December 4, 1979

INVENTOR(S) : Pierre Repetti

It is certified that error appears in the above—identified patent and that said Letters Patent is hereby corrected as shown below:

The sole sheet of drawing should be deleted to insert the attached sheets 1 thru 3 therefor.

THIS CERTIFICATE APPLYS TO THE GRANT. EXCLUSIVELY.

Signed and Sealed this

*Nineteenth* Day of *February 1980*

[SEAL]

*Attest:*

SIDNEY A. DIAMOND

*Attesting Officer*

*Commissioner of Patents and Trademarks*

FIG.3
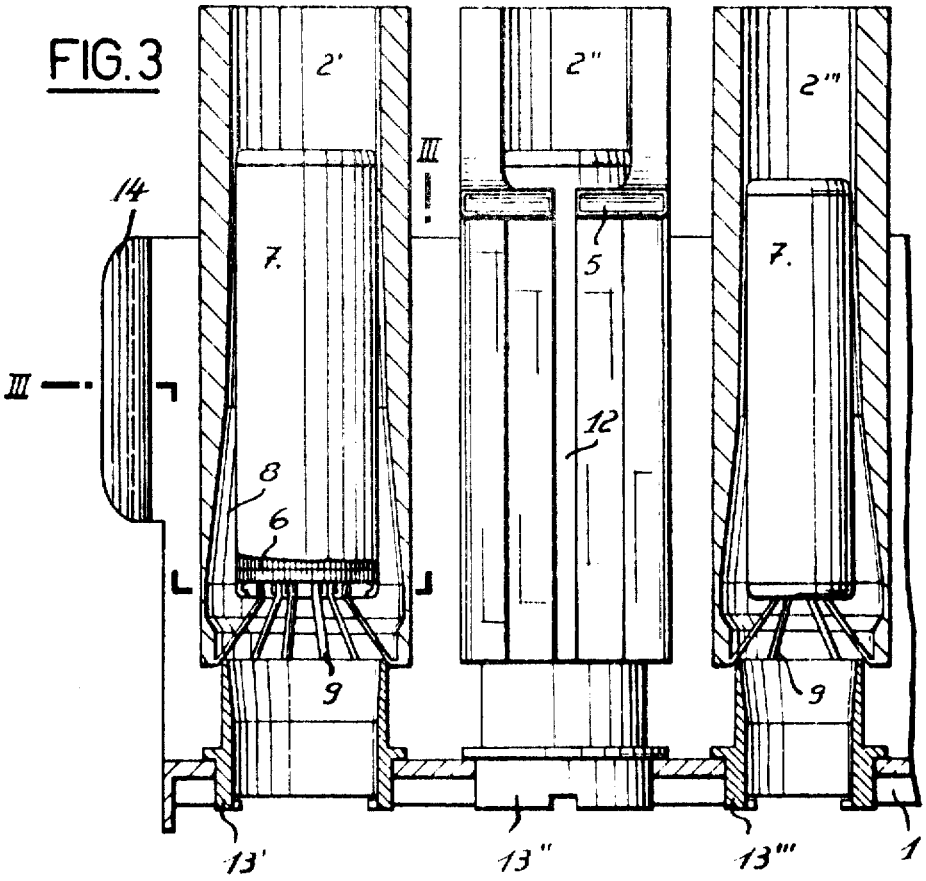
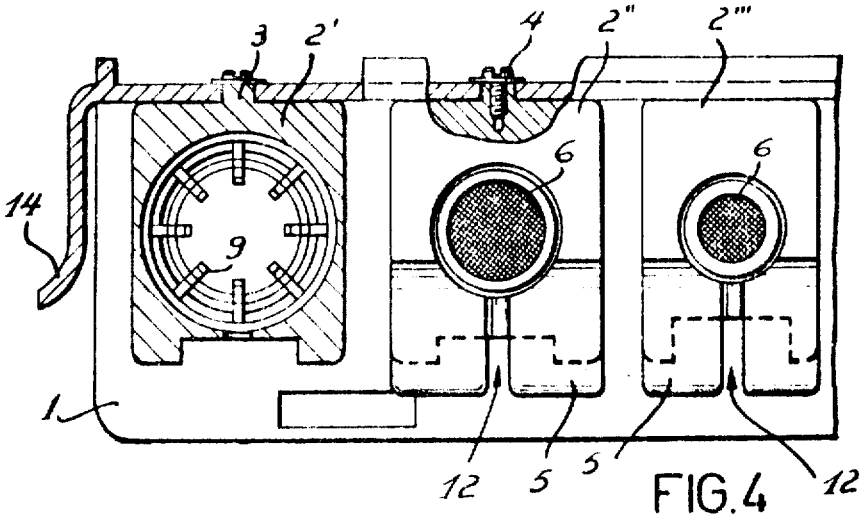
FIG.4